US006725468B2

(12) United States Patent
Molina

(10) Patent No.: US 6,725,468 B2
(45) Date of Patent: Apr. 27, 2004

(54) COMBINATION PLUG DEVICE AND COVER PLATE

(75) Inventor: Devin C. Molina, Huntington Beach, CA (US)

(73) Assignee: Smith Molina, Inc., Mission Viejo, CA (US)

( * ) Notice: Subject to any disclaimer, the term of this patent is extended or adjusted under 35 U.S.C. 154(b) by 229 days.

(21) Appl. No.: 10/073,502

(22) Filed: Feb. 11, 2002

(65) Prior Publication Data

US 2003/0150500 A1 Aug. 14, 2003

(51) Int. Cl.[7] ..... F16L 55/132; F16L 57/00

(52) U.S. Cl. ..... 4/252.1; 138/89; 138/96 R; 249/177

(58) Field of Search ..... 138/89, 90, 96 R; 4/293, 295, 286, 252, 252.1, 679, 694, 254, 252.4, 420; 220/327, 328; 249/177, 210; 52/244

(56) References Cited

U.S. PATENT DOCUMENTS

| | | | | | |
|---|---|---|---|---|---|
| 848,493 | A | | 3/1907 | Redenbaugh | |
| 986,297 | A | | 3/1911 | Kinkade | |
| 1,557,966 | A | | 10/1925 | Benshadle | |
| 2,064,569 | A | | 12/1936 | Santucci | |
| 2,218,581 | A | | 10/1940 | Levan | |
| 2,512,041 | A | | 6/1950 | Steele | |
| 2,667,139 | A | * | 1/1954 | Campbell | 269/48.1 |
| 3,675,685 | A | * | 7/1972 | Potter | 138/89 |
| 3,747,541 | A | * | 7/1973 | Reese | 109/50 |
| 3,924,733 | A | * | 12/1975 | DeLong | 206/1.7 |
| 3,996,966 | A | * | 12/1976 | Princell | 138/89 |
| 4,233,697 | A | | 11/1980 | Cornwall | |
| 4,423,753 | A | * | 1/1984 | Smith et al. | 138/89 |
| 4,493,344 | A | | 1/1985 | Mathison et al. | |
| 4,494,666 | A | * | 1/1985 | Cooper et al. | 220/582 |
| D300,350 | S | | 3/1989 | Mathison | |
| 4,915,137 | A | * | 4/1990 | Hall et al. | 138/96 R |
| 4,967,422 | A | * | 11/1990 | Novak | 4/252.1 |
| 5,329,971 | A | | 7/1994 | Condon | |
| 5,351,718 | A | * | 10/1994 | Barton | 138/92 |
| 5,695,222 | A | | 12/1997 | Hodges | |
| 5,975,142 | A | | 11/1999 | Wilson | |

FOREIGN PATENT DOCUMENTS

WO WO 00/03172 1/2000

OTHER PUBLICATIONS

Cherne Industries, Plastic Gripper Plugs, http://www.cherneind.com/udrgnd/mech/gripper..htm, Feb. 11, 2002.

* cited by examiner

*Primary Examiner*—James Hook
(74) *Attorney, Agent, or Firm*—Eric Karich

(57) ABSTRACT

A cover plate has an inner surface shaped to contact a closet flange and an opposing outer surface. The cover plate is adapted for covering a drain pipe end having a closet flange that extends perpendicular to the drain pipe end. The inner and outer surfaces terminate in an outer cover perimeter having approximately the same diameter as an outer flange perimeter of the closet flange. The outer cover perimeter has a protective sidewall that extends upwardly, normal to the outer surface, for protecting the closet flange and facilitating the installation of floor tile adjacent the closet flange. The cover plate includes cover apertures positioned to coincide with flange apertures of the closet flange. The cover plate further includes cover locking bolts and cover locking nuts adapted to be positioned through the flange apertures and the cover apertures for removably fastening the cover plate to the closet flange.

20 Claims, 3 Drawing Sheets

COMBINATION PLUG DEVICE AND COVER PLATE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to plug devices, and more particularly to a combination plug device and cover plate, the cover plate functioning to hold the plug device in a drain pipe end and also to protect a closet flange that extends perpendicular to the drain pipe end.

2. Description of Related Art

The following art defines the present state of this field:

Mathison et al., U.S. Pat. No. 4,493,344, teaches a mechanically operable plug device is for use with the end of a pipe or conduit. The plug device is for removably sealing the conduit end so that the conduit can be tested for leaks. The mechanically operable plug device is comprised of two spacially parallel plate members, a narrow, elastomeric, and radially expandable O-ring member which is disposed between the plate members, and adjustable lateral force means which is operable on the parallel plate members. The radially expandable O-ring member has a circumferentially disposed surface for engaging the interior surface of a conduit to be sealed, and a generally V-shaped cross section having inclined surfaces of a predetermined slope. The plate members have interiorly facing tapered shoulders of generally the same predetermined slope to engage the inclined surfaces of the O-ring. Subsequent to the placement of the plug device into a conduit end, the positive adjustment of the lateral force means causes the sloped opposing shoulders to impart lateral forces to the inclined surfaces of the O-ring to, thereby, cause it to expand outwardly to seal a conduit.

Condon, U.S. Pat. No. 5,329,971, teaches an apparatus for sealing the central opening in a conventional closet flange extending perpendicular to a drain pipe. A generally disk-shaped sealing member is connected to the lower end of a threaded shaft screwed through an intermediate hub in a diametrically extending mounting body. A pair of L-shaped retaining arms are pivotally connected to corresponding ends of the mounting body. Heads on the lower ends of the retaining arms may be inserted through diametrically spaced key-shaped slots in the closet flange and engaged with the underside of the flange. A handle connected to the upper end of the shaft may be turned to screw the shaft downwardly. This firmly presses an elastomeric boot on a convex underside of the sealing member against an inner edge of the central opening in the closet flange. This seals the opening in the closet flange to permit pressure testing of the drain and its associated sewer system.

Cornwall, U.S. Pat. No. 4,233,697, teaches a protective cover or cap for connection to a toilet mounting flange installed on a drain or discharge pipe. The cover protects the stems of bolts for connecting the flange to the toilet by means of at least two tubular extensions on the cover which surround the bolts and by means of nuts over washers on the bolt stems when the cover is installed on the flange. The cover makes it much easier to align the flange visually with the surrounding walls by means of the tubular extensions for the bolts. In addition, the cover is adapted for hydrostatic testing of the drainage system, prevents any foreign material from entering the discharge pipe and protects the slots and holes in the flange from becoming clogged or filled.

Various other similar devices are shown in the following: Wilson, U.S. Pat. No. 5,975,142; G. Steele, U.S. Pat. No. 2,512,041; J. F. Levan, U.S. Pat. No. 2,218,581; B. B. Kinkade, U.S. Pat. No. 986,297; A. Redenbaugh, U.S. Pat. No. 848,493; N. Santucci, U.S. Pat. No. 2,064,569; O. Benshadle, U.S. Pat. No. 1,557,966; Mathison, U.S. Des. 300,350; Berneski, WO 00/03172, and Hodges, U.S. Pat. No. 5,695,222. The above-described references are hereby incorporated by reference in full.

The prior art teaches various plug devices that can be used to temporarily close a drain pipe end. However, the prior art does not teach a combination plug device and cover plate, the cover plate functioning to hold the plug device in a drain pipe end and also to protect a closet flange that extends perpendicular to the drain pipe end. The present invention fulfills these needs and provides further related advantages as described in the following summary.

SUMMARY OF THE INVENTION

The present invention teaches certain benefits in construction and use which give rise to the objectives described below.

The present invention provides a cover plate for covering a drain pipe end having a closet flange that extends perpendicular to the drain pipe end. The cover plate includes an inner surface shaped to contact the closet flange and an opposing outer surface. The inner and outer surfaces terminate in an outer cover perimeter having approximately the same diameter as an outer flange perimeter of the closet flange. The outer cover perimeter has a protective sidewall that extends upwardly, normal to the outer surface. The cover plate further includes cover apertures positioned to coincide with the flange apertures of the closet flange, and a means for removably fastening the cover plate to the closet flange.

A primary objective of the present invention is to provide a cover plate having advantages not taught by the prior art.

Another objective is to provide a cover plate that will lock a plug device inside a drain pipe and prevent internal pressure from pushing the plug device out of the drain pipe.

Another objective is to provide a cover plate that functions to protect a closet flange of the drain pipe from being clogged with grout or other material.

A further objective is to provide a cover plate with a protective sidewall that provides a surface that can be used to guide installation of floor tile or other floor covering materials.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a combination plug device and cover plate 10 for removably sealing a drain pipe end 14 of a drain pipe 12.

Figure 1:
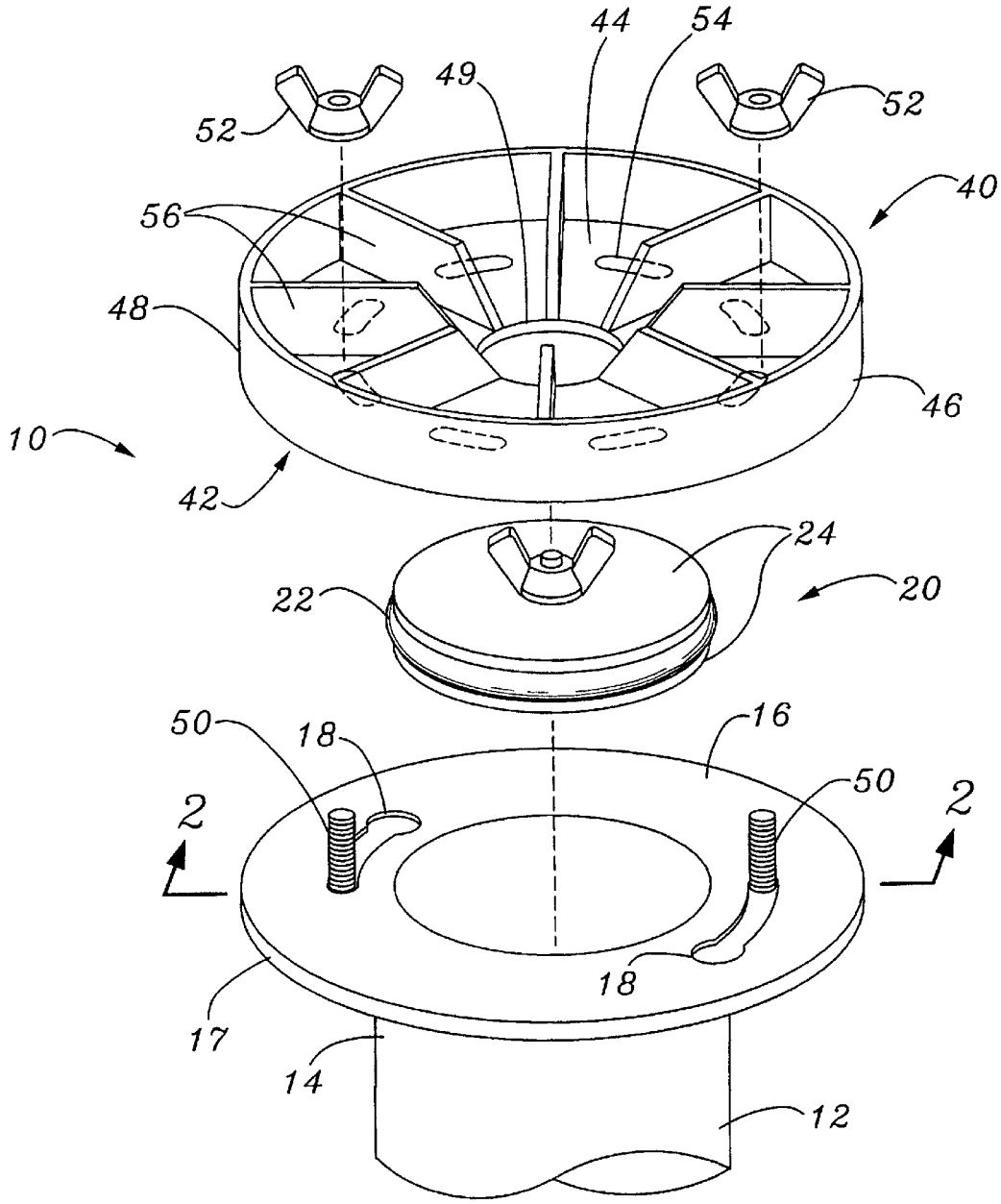
FIG. 1 is a perspective view of one embodiment of the present invention, a combination plug device and cover plate.
Figure 2:
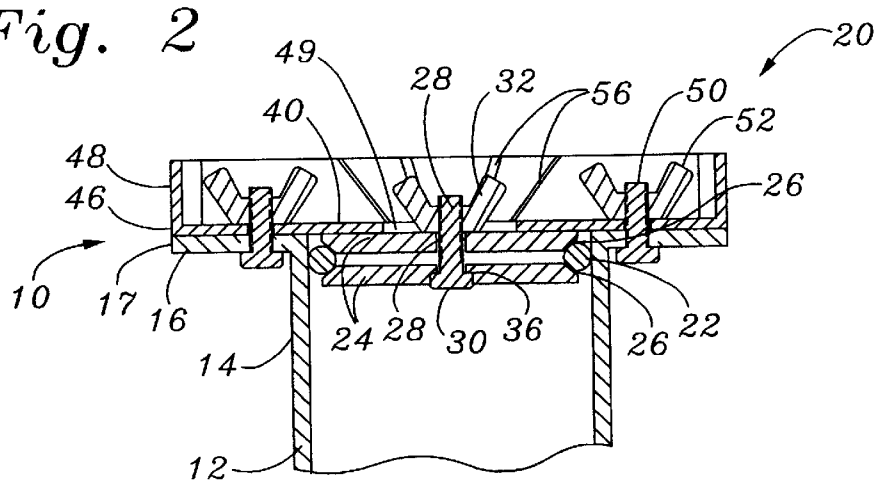
FIG. 2 is a sectional view thereof taken along line 2—2 in FIG. 1.

As shown in FIGS. 1–2, the combination 10 includes a hand operable plug device 20 for plugging the drain pipe end 14; and the combination 10 also includes a cover plate 40 for locking the plug device 20 in place and for protecting a closet flange 16 that extends perpendicular to the drain pipe end 14 and terminates in an outer flange perimeter 17. The drain pipe 12 upon which the combination 10 is installed is typically a drain or discharge pipe used to receive the discharge from a toilet bowl. The closet flange 16 includes flange apertures 18 that are used in attaching the closet flange 16 to a toilet bowl (not shown). Such a construction is described in Cornwall, U.S. Pat. No. 4,233,697, hereby incorporated by reference. Since the structure of the drain pipe 12 is well known in the art, it is not described in greater detail herein.

As shown in FIGS. 1–2, the hand operable plug device 20 includes an elastomeric radially expandable O-ring 22, spacially parallel rigid plate members 24 having interiorly facing tapered shoulders 26 shaped to engage the O-ring 22, and a hand adjustable lateral force means operable on the parallel plate members 24. Once the plug device 20 is placed into the drain pipe end 14, the positive adjustment of the lateral force means causes the sloped opposing shoulders to impart lateral forces to the O-ring 22 to, thereby, cause it to expand outwardly to seal the drain pipe end 14. The structure of the hand operable plug device 20 is described in Mathison, U.S. Pat. No. 4,493,344, hereby incorporated by reference.

As shown in FIG. 2, the hand adjustable lateral force means preferably includes a threaded bolt 28 and plug nut 32. In this embodiment, the plate members 24 have central, axial apertures 34 extending therethrough for receiving the threaded bolt 28. The bolt 28 has a head portion 30 for non-rotationally engaging a slotted aperture 36 of the innermost of the plate members 24. The plug nut 32 is preferably a wing nut that enables the plug nut 32 to be hand operable to adjustably impart lateral squeezing forces through the opposing tapered shoulders 26 of the plate members 24 to radially expand the O-ring 22. Obviously, those skilled in the art can devise alternative embodiments that are equivalent to the above-described structure, and such alternatives should be considered within the scope of the claimed invention.

As shown in FIGS. 1–2, the cover plate 40 has an inner surface 42, an opposing outer surface 44, and an outer cover perimeter 46. The cover plate 40 is preferably constructed of an integrally molded rigid plastic material, although other materials could be adopted to the task. The inner surface 42 is shaped to contact the closet flange 16 and preferably also the plug device 20 to hold the plug device 20 inside the drain pipe end 14. The outer cover perimeter 46 has a protective sidewall 48 that extends upwardly, normal to the outer surface 44, at least 0.5 inches. The protective sidewall 48 is preferably between 0.5–2.0 inches, and most preferably at least 1.1 inches and less than 1.75 inches. While the term "normal" generally refers only to an orientation in which the sidewall intersects the outer surface 44 at a 90 degree angle, for purposes of this application, the term "normal" should be considered to include any orientation that results in the protective sidewall 48 extending upwardly in a manner that positions the protective sidewall 48 to protect the closet flange 16. This will typically require that the protective sidewall 48 extend at an angle of between 60–120 degrees from the outer surface, but it is possible that one could devise an arrangement that is structurally equivalent but outside of this particular range.

Figure 3:
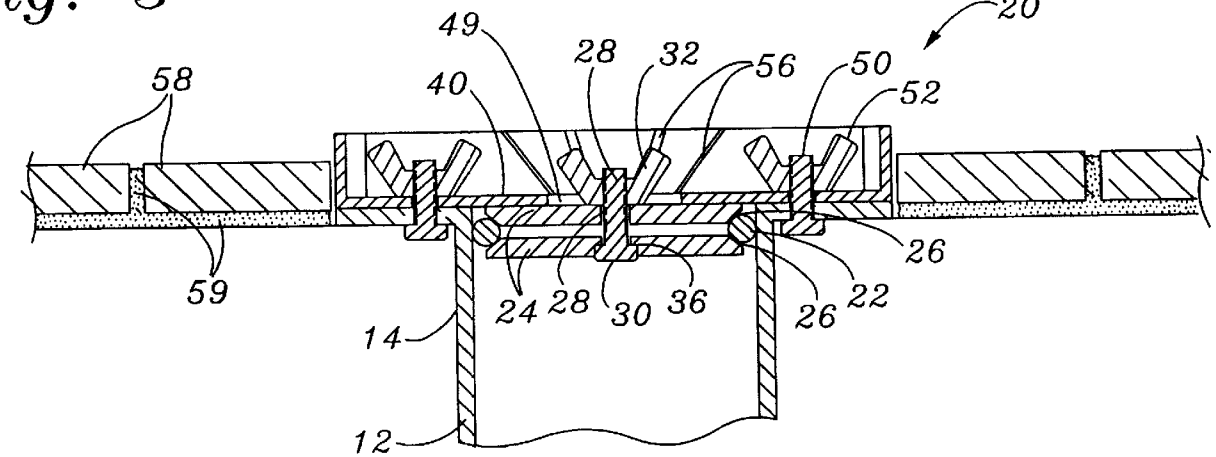
FIG. 3 is an alternative sectional view taken along line 2—2 in FIG. 1, illustrating how the cover plate can be used to facilitate the installation of tile adjacent the cover plate.
Figure 4:
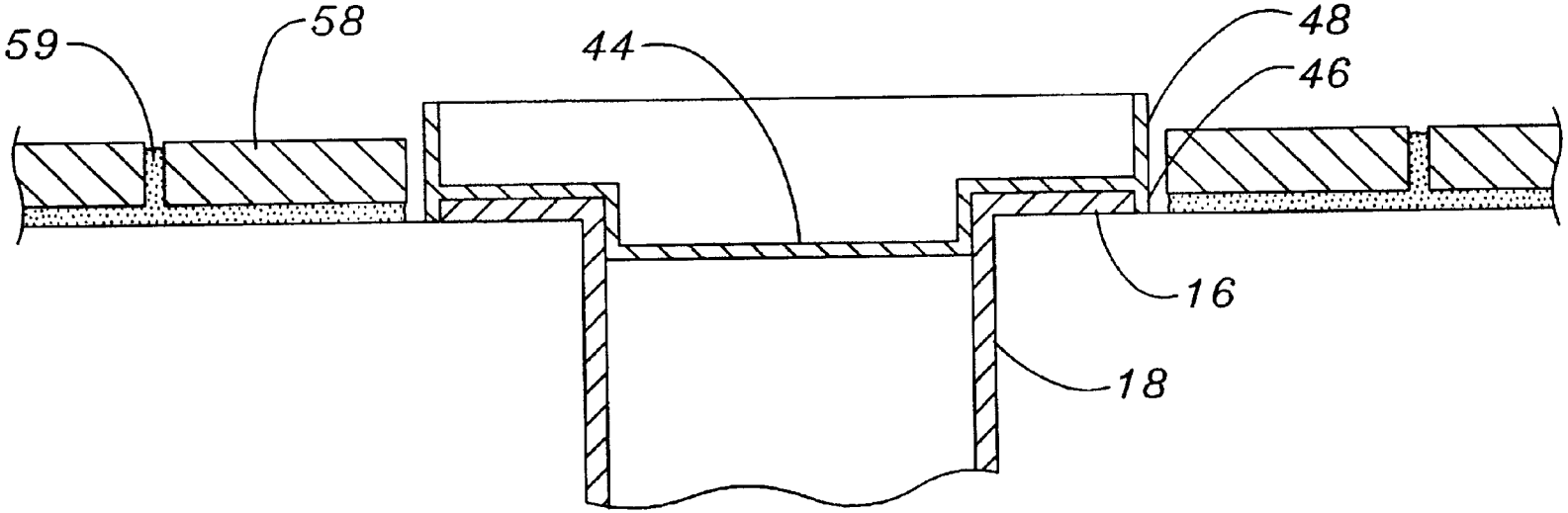
FIG. 4 is an alternative sectional view, similar to FIG. 3, illustrating an alternative embodiment of the invention.

As shown in FIGS. 3–4, the outer cover perimeter 46 is shaped to generally conform to the outer flange perimeter 17, and has a diameter that is generally the same as the outer flange perimeter 17 so that the protective sidewall 48 is positioned to protect the closet flange 16. The protective sidewall 48 also provides a surface that can be used to guide installation of floor tile 58 or other floor covering materials. This not only assists in the construction of the floor tile 58, it also prevents grout 59 from the floor tile 58 from clogging the closet flange 16.

As shown in FIGS. 1–2, the cover plate 40 preferably also includes an inner cover aperture 49 having a diameter of less than the diameter of the parallel rigid plate members 24, and less than the diameter of the drain pipe end 14, yet being shaped to allow access to the hand adjustable lateral force means. The inner cover aperture 49 enables the user the check the plug device 20 and to tighten the hand adjustable lateral force means without interfering with the function of the cover plate 40 to help hold the plug device 20 within the drain pipe end 14. In one particular alternative embodiment, not shown, the inner cover aperture 49 is only large enough to accommodate the threaded bolt 28 and the plug nut abuts the outer surface 44 of the cover plate 40 and compresses the cover plate 40 along with the plate members 24. Such alternatives should be considered within the scope of the claimed invention.

As shown in FIGS. 1–2, the cover plate 40 further includes a means for removably fastening the cover plate 40 to the closet flange 16. In one embodiment, the means for removably fastening includes cover locking bolts 50 and cover locking nuts 52. In this embodiment, the cover plate 40 includes cover apertures 54 through both the inner and outer surfaces 42 and 44 positioned to coincide with the flange apertures 18 of the closet flange 16. Each of the cover locking bolts 50 is shaped to fit through one of the flange apertures 18 of the closet flange 16 and a corresponding one of the cover apertures 54 the cover apertures 54. Each of the cover locking nuts 52 is shaped to threadedly engage one of the cover locking bolts 50 to lock the cover plate 40 against the closet flange 16. In one embodiment, the cover locking nuts 52 are wing nuts to enable the user to hand-tighten the cover locking nuts 52 without requiring the use of a tool.

In another embodiment, the means for removably fastening is simply an adhesive used to attach the cover plate 40 to the closet flange 16. Obviously, alternative structures or method can be used to attach the cover plate 40 to the closet flange 16, and such alternative structures should be construed as within the scope of the claimed invention.

Finally, the cover plate 40 preferably further includes radial sidewalls 56 that extend upwardly from and normal to the outer surface 44, and project radially outwardly to form an integral connection with the protective sidewall 48. The radial sidewalls 56 provide the dual function of both strengthening to the cover plate 40 and also supporting the protective sidewall 48.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A cover plate for covering a drain pipe end, the drain pipe end having a closet flange that extends perpendicular to the drain pipe end and terminates in an outer flange perimeter, the closet flange having flange apertures, the combination comprising:

an inner surface shaped to contact the closet flange;

an opposing outer surface;

cover apertures through both the inner and outer surfaces positioned to coincide with the flange apertures of the closet flange;

the inner and outer surfaces terminating in an outer cover perimeter having approximately the same diameter as the outer flange perimeter and being shaped to conform to the outer flange perimeter, the outer cover perimeter having a protective sidewall that extends upwardly, normal to the outer surface; and a means for removably fastening the cover plate to the closet flange.

2. The cover plate of claim 1 wherein the means for removably fastening includes cover locking bolts and cover locking nuts, each of the cover locking bolts being shaped to fit through one of the flange apertures and through one of the cover apertures and lockingly engage the closet flange so that the cover locking bolt does not rotate, each of the cover locking nuts being shaped to threadedly engage one of the cover locking bolts to lock the cover plate against the closet flange.

3. The cover plate of claim 2 wherein the cover locking nuts are wing nuts.

4. The cover plate of claim 1 wherein the protective sidewall extends upwardly at least 0.5 inches.

5. The cover plate of claim 1 wherein the protective sidewall extends upwardly between 0.5–2.0 inches.

6. The cover plate of claim 1 wherein the protective sidewall extends upwardly between 1.1–1.75 inches.

7. The cover plate of claim 1 further comprising radial sidewalls that extend upwardly from and normal to the outer surface, and project radially outwardly to form an integral connection with the protective sidewall.

8. The cover plate of claim 1 further comprising an inner cover aperture having a diameter of less than the diameter of the drain pipe end.

9. A combination plug device and cover plate for removably sealing a drain pipe end, the drain pipe end having a closet flange that extends perpendicular to the drain pipe end and terminates in an outer flange perimeter, the combination comprising:

a hand operable plug device having an elastomeric radially expandable O-ring, spacially parallel rigid plate members having interiorly facing tapered shoulders shaped to engage the O-ring, and a hand adjustable lateral force means operable on the parallel plate members, whereby, subsequent to the placement of the plug device into the drain pipe end, the positive adjustment of the lateral force means causes the sloped opposing shoulders to impart lateral forces to the O-ring to, thereby, cause it to expand outwardly to seal the drain pipe end;

a cover plate having an inner surface, an opposing outer surface, an inner cover aperture and an outer cover perimeter, the inner cover aperture having a diameter of less than the diameter of the parallel rigid plate members yet being shaped to allow access to the hand adjustable lateral force means, and the outer cover perimeter having the same diameter as the outer flange perimeter, the outer cover perimeter having a protective sidewall that extends upwardly, normal to the outer surface; and a means for removably fastening the cover plate to the closet flange.

10. The combination of claim 9 wherein the means for removably fastening includes cover locking bolts and cover locking nuts, each of the cover locking bolts being shaped to fit through one of the flange apertures and through one of the cover apertures and lockingly engage the closet flange so that the cover locking bolt does not rotate, each of the cover locking nuts being shaped to threadedly engage one of the cover locking bolts to lock the cover plate against the closet flange.

11. The combination of claim 10 wherein the cover locking nuts are wing nuts.

12. The combination of claim 9 wherein the protective sidewall extends upwardly at least 0.5 inches.

13. The combination of claim 9 wherein the protective sidewall extends upwardly between 0.5–2.0 inches.

14. The combination of claim 9 wherein the protective sidewall extends upwardly between 1.1–1.75 inches.

15. The combination of claim 9 wherein the cover plate further includes radial sidewalls that extend upwardly from and normal to the outer surface, and project radially outwardly to form an integral connection with the protective sidewall.

16. The combination of claim 9 wherein the cover plate further includes an inner cover aperture having a diameter of less than the diameter of the drain pipe end.

17. A cover plate for covering a drain pipe end, the drain pipe end having a closet flange that extends perpendicular to the drain pipe end and terminates in an outer flange perimeter, the closet flange having flange apertures, the combination comprising:

an inner surface shaped to contact the closet flange;

an opposing outer surface;

the inner and outer surfaces terminating in an outer cover perimeter being shaped to generally conform to the outer flange perimeter, the outer cover perimeter having a protective sidewall that extends upwardly, normal to the outer surface; and a means for removably fastening the cover plate to the closet flange.

18. The cover plate of claim 17 wherein the protective sidewall extends upwardly at least 0.5 inches.

19. The cover plate of claim 17 wherein the protective sidewall extends upwardly between 1.1–1.75 inches.

20. The cover plate of claim 17 further comprising radial sidewalls that extend upwardly from and normal to the outer surface, and project radially outwardly to form an integral connection with the protective sidewall.

* * * * *